US006488480B1

(12) United States Patent
Zhong

(10) Patent No.: US 6,488,480 B1
(45) Date of Patent: Dec. 3, 2002

(54) HOUSING FOR SCREW COMPRESSOR

(75) Inventor: JianPing Zhong, Chesterton, IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/853,812

(22) Filed: May 11, 2001

(51) Int. Cl.[7] ..... F04B 39/06; F04B 49/03; F04C 18/16

(52) U.S. Cl. ..... 417/310; 417/371; 417/410.4; 418/197

(58) Field of Search ..... 418/197, 201.1; 417/310, 371, 410.4

(56) References Cited

U.S. PATENT DOCUMENTS

| | | | | |
|---|---|---|---|---|
| 3,809,510 A | * | 5/1974 | Gregerson et al. | 417/310 |
| 4,181,474 A | | 1/1980 | Shaw | 417/366 |
| 5,222,874 A | | 6/1993 | Unnewehr et al. | 417/372 |
| 5,246,349 A | | 9/1993 | Hartog | 417/371 |
| 5,807,091 A | | 9/1998 | Shaw | 418/197 |
| 6,045,344 A | | 4/2000 | Tsuboi et al. | 418/201.1 |

FOREIGN PATENT DOCUMENTS

| | | | | |
|---|---|---|---|---|
| DE | 235303 | * | 4/1986 | 417/310 |
| JP | 54-34111 | * | 3/1979 | 417/410.4 |
| JP | 54-115409 | * | 9/1979 | 418/201.1 |
| JP | 6-173871 | * | 6/1994 | 418/201.1 |

* cited by examiner

*Primary Examiner*—John J. Vrablik
(74) *Attorney, Agent, or Firm*—Bachman & LaPointe, P.C.

(57) ABSTRACT

A housing for a screw compressor, includes a single-piece casting defining a motor housing section and a rotor housing section and has an inlet for compressor medium, an outlet end and a bridge member disposed between the motor housing section and the rotor housing section and defining an inlet side bearing housing; a discharge housing mounted to the outlet end and defining an outlet and a discharge side bearing housing; and at least one rotor disposed in the rotor housing section and rotatably mounted between the inlet side bearing housing and the discharge side bearing housing.

10 Claims, 3 Drawing Sheets

HOUSING FOR SCREW COMPRESSOR

BACKGROUND OF THE INVENTION

The invention relates to a housing for a screw compressor and, more particularly, to a housing for a hermetic multi-rotor screw compressor.

Screw compressors typically have several different housing members. A housing must be provided for the rotor or rotors, and a separate housing is typically provided for the motor which drives the rotors. Separate housings are typically required due to the length of the rotors, and for other reasons.

These housing designs can be problematic in providing a hermetic compressor. Further, access to the rotor for servicing and the like is difficult in that entire housing members must be repositioned to access same, and these housings are heavy and bulky.

Multi-rotor screw compressors typically have multiple discharge ports, see for example U.S. Pat. No. 5,807,091 to Shaw. These discharge ports typically remove refrigerant or other compressed medium from the rotors in a radially outward direction and then convey this flow to a collection chamber for discharging a single stream. The positioning of these discharge ports and collection chambers impose a change in direction of flow on the refrigerant which can cause reduction in efficiency.

The motor portion of such compressors tends to general heat and requires cooling. Cooling cab be accomplished with oil or other cooling medium, and U.S. Pat. No. 6,045,344 shows a compressor wherein coolant is passed through the motor housing by an end suction which causes the cooling medium to pass through the entire motor assembly.

It is clear that the need remains for an improved housing for screw compressors so as to address the aforesaid disadvantages.

It is therefore the primary object of the present invention to provide such a housing.

It is a further object of the present invention to provide a housing including a discharge port which improves flow efficiency of refrigerant or other compressor medium.

It is a still further object of the present invention to provide such a housing which provides for simplified cooling of the motor.

It is another object of the present invention to provide a housing which has a low manufacturing cost.

Other objects and advantages of the present invention will appear hereinbelow.

SUMMARY OF THE INVENTION

The foregoing objects and advantages of the present invention have been readily attained.

In accordance with the present invention, a housing for a screw compressor is provided, which comprises a single-piece casting defining a motor housing section and a rotor housing section and having an inlet for compressor medium, an outlet end and a bridge member disposed between said motor housing section and said rotor housing section and defining an inlet side bearing housing; a discharge housing mounted to said outlet end and defining an outlet and a discharge side bearing housing; and at least one rotor disposed in said rotor housing section and rotatably mounted between said inlet side bearing housing and said discharge side bearing housing.

In accordance with one aspect of the invention, the inlet is arranged so as to introduce compressor medium into the housing between the motor housing section and the rotor housing section, by suction, which leads to cooling of the motor housing section as the compressor medium is passed to the rotors.

In accordance with a further aspect of the present invention, the bridge member extends inwardly from an inner surface of the housing so as to define an inlet side bearing housing for the rotors and motor, while allowing compressor medium to flow around the bridge through flow channels defined therebetween and to the rotors.

In accordance with yet another aspect of the present invention, the discharge housing defines discharge ports for the rotor which extend away from the rotor both radially and axially so as to provide for more efficient flow of compressor medium from the rotors to the discharge pipe.

BRIEF DESCRIPTION OF THE DRAWING

A detailed description of preferred embodiments of the present invention follows, with reference to the attached drawings, wherein.

DETAILED DESCRIPTION

The invention relates to a screw compressor and, more particularly, to a housing design for a multi-rotor screw compressor, preferably a tri-rotor screw compressor, wherein the housing is advantageously a single casting and various other advantages are provided.

Multi-screw compressor may for example have a male rotor and at least two female rotors, and helical type compressors are well known in the art. In such a configuration, the male rotor is typically the drive rotor, and is driven by a motor of the compressor, and such compressors find use in numerous environments, for example in the heating, ventilation, refrigeration and air conditioning (HVRAC) industry.

Referring to the figures, a compressor including a housing in accordance with the present invention is illustrated.

Figure 1:
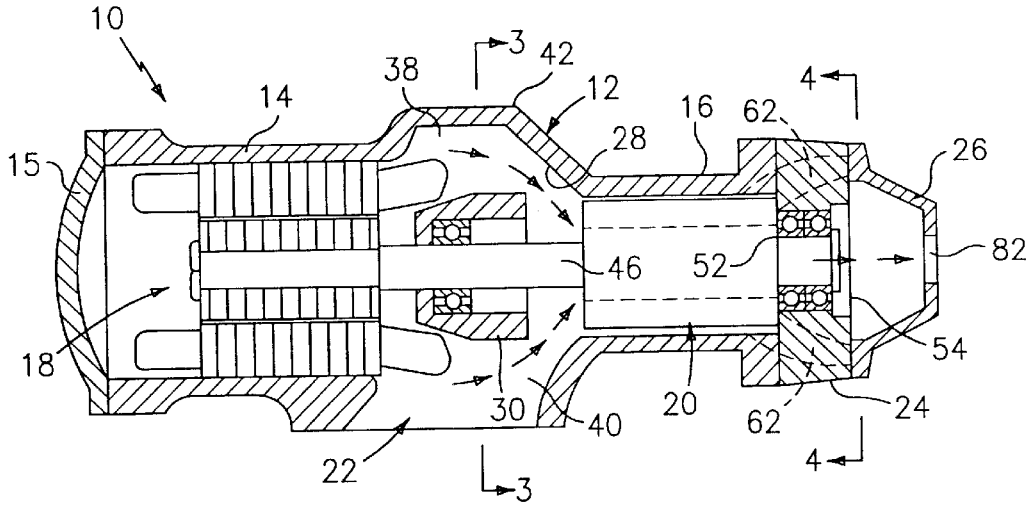
FIG. 1 illustrates a side sectional view of a compressor including a housing in accordance with the present invention.

FIG. 1 shows a compressor 10 having a housing 12 defining a motor housing section 14 and a rotor housing section 16. Housing 12 in accordance with the present invention is preferably a single-piece casting so as to facilitate use of the housing in providing a hermetic screw compressor assembly.

A motor 18 is disposed in motor housing section 14, and one or more rotors 20 are disposed in rotor housing section 16. Motor 18 drives rotors 20 so as to draw refrigerant or other compressor medium into an inlet 22 of housing 12 for feed to rotors 20 as desired. Rotors 20 compress the refrigerant drawn therein, and discharge such compressor medium through a discharge housing 24 to a collection chamber 26 and on to the intended use of the discharged medium.

An end cover 15 may advantageously be provided closing the end of motor housing section 14.

Figure 2:
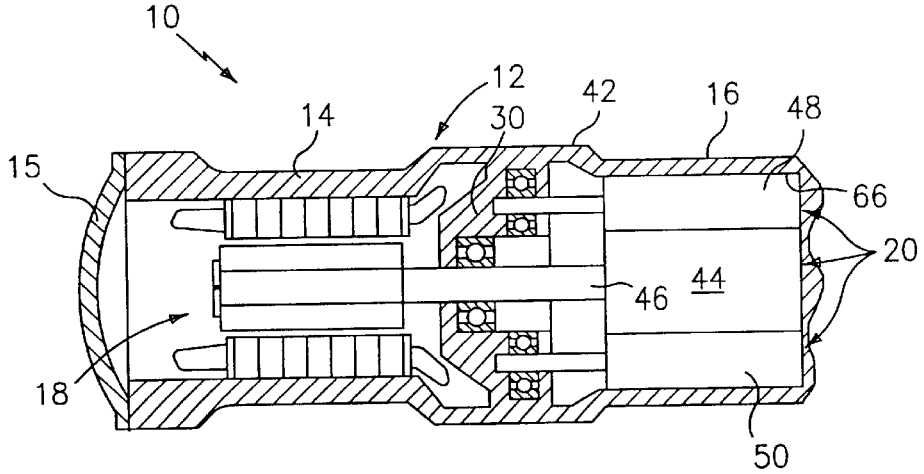
FIG. 2 illustrates a further sectional view of the housing of FIG. 1, sectioned at a 90° angle to the view of FIG. 1.
Figure 3:
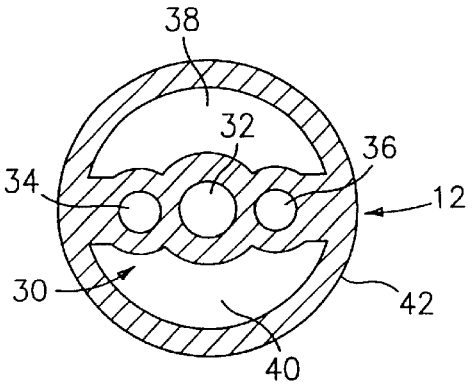
FIG. 3 is a cross section taken through the housing of FIG. 1 to illustrate the structure of the bridge member.

Referring to FIGS. 1 and 2 together, housing 12 has an inner surface 28 which serves to define the various housing sections, and from which a bridge member 30 extends so as to define an inlet side bearing housing. Referring also to FIG. 3, which is a cross sectional view taken through bridge member 30, it is readily apparent that bridge member defines three bearings 32, 34, 36, and further defines two flow channels 38, 40 between bridge member 30 and inner surface 28.

Bearing 32 serves to receive a central or sun rotor as will be discussed below, and bearings 34, 36 are positioned to receive two corresponding planet rotors so as to define a trirotor assembly. Further, motor 18 is typically operatively associated with or directly connected to the sun rotor through bridge member 30 as illustrated in FIGS. 1 and 2.

Also as shown in FIGS. 1 and 2, housing 12 may advantageously have an increased diameter section 42 positioned at the location of bridge member 30 so as to further define an inlet area for receiving compressor medium through inlet 22, by suction, as desired. As shown by arrows in FIG. 1, compressor medium flows through inlet 22 and around bridge member 30, through flow channels 38, 40 so as to feed rotors 20 from both sides of bridge member 30. This is advantageous in providing efficient flow of refrigerant to the rotors.

Still referring to FIGS. 1–3 and particularly to FIG. 1, positioning of inlet 22 between motor housing section 14 and rotor housing section 16 advantageously provides for flow of compressor medium past a portion of motor 18 so as to provide a cooling of same. This is accomplished without flowing compressor medium through motor housing section 14 as is done in the prior art.

Referring to FIG. 2, sun rotor 44 is schematically illustrated and connected to motor 18 through a shaft 46 which passes through bridge member 30 and sun rotor bearing 32.

FIG. 2 also illustrates planet rotors 48, 50 rotatably disposed in planet rotor bearings 34, 36 and engaged with sun rotor 44 for being driven by same.

Figure 4:
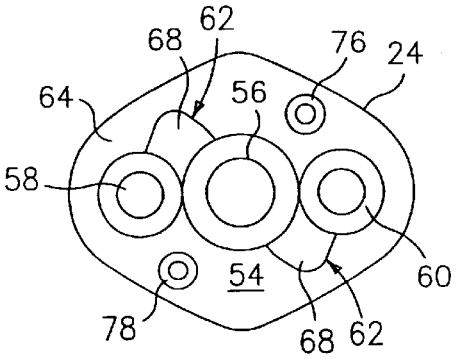
FIG. 4 is a cross section taken through an end cap of the housing of FIG. 1 to show the discharge ports in accordance with the present invention.
Figure 5:
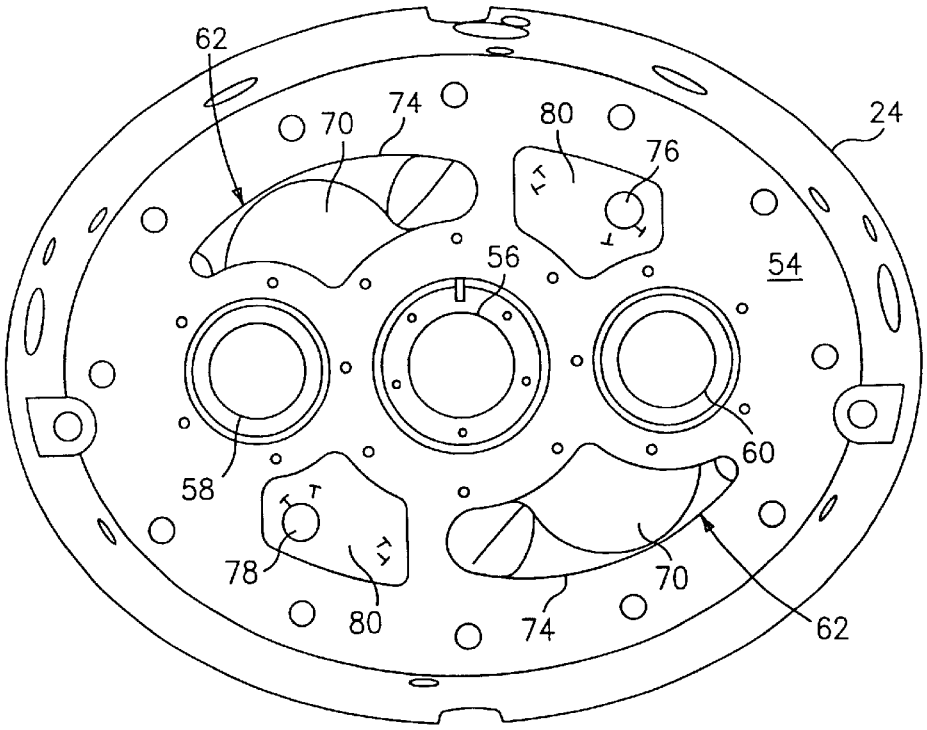
FIG. 5 is a discharge side view of a discharge housing in accordance with the present invention.
Figure 6:
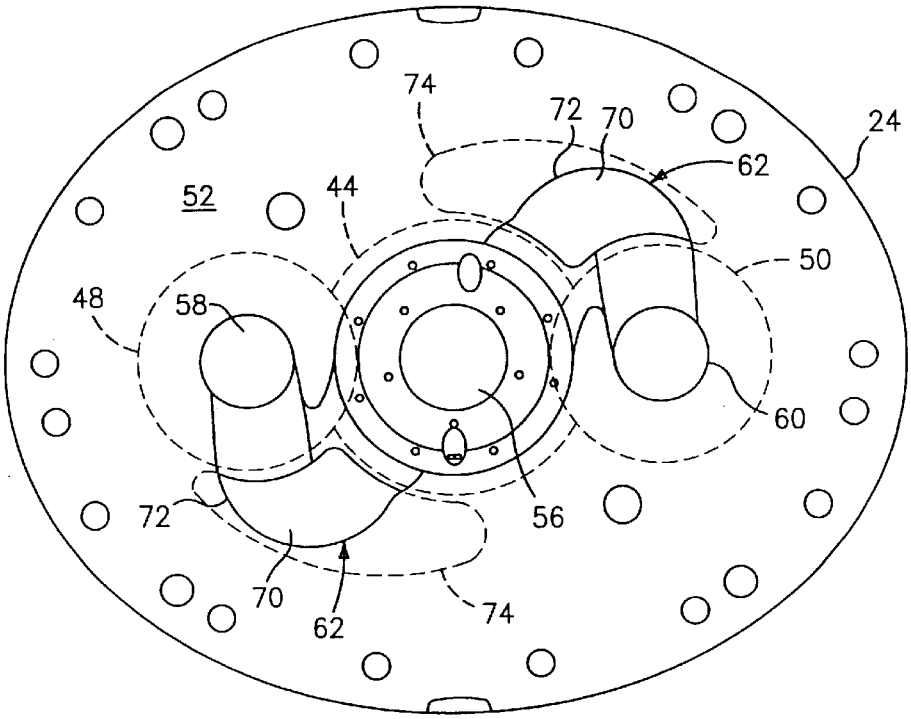
FIG. 6 is a rotor-side view of a discharge housing in accordance with the present invention.

Turning now to FIGS. 4, 5 and 6, discharge housing 24 is further illustrated. In accordance with the present invention, discharge housing 24 advantageously defines a discharge bearing housing for receiving the discharge ends of sun rotor 44 and planet rotors 48, 50. Discharge housing 24 advantageously has a rotor side surface 52 which is illustrated in FIG. 6 and a discharge side surface 54 which is illustrated in FIGS. 4 and 5. As shown in these figures, discharge housing 24 defines a sun rotor bearing 56 and two planet rotor bearings 58, 60. Discharge housing 24, by being connectable and removable from housing 12, advantageously allows access to rotors disposed in housing 12 without requiring separation of the entire rotor housing from the entire motor housing as is required in conventional devices.

Figure 7:
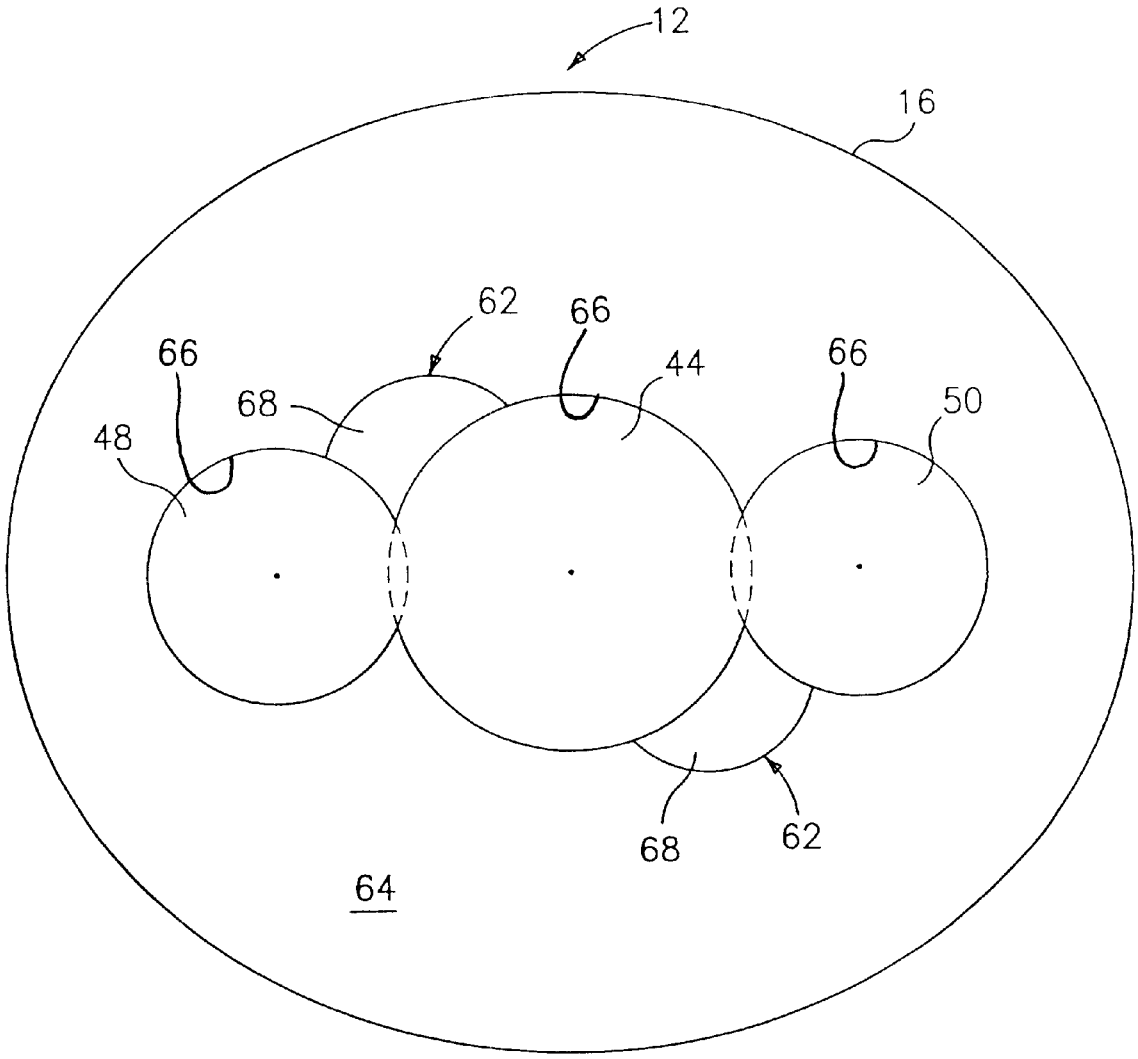
FIG. 7 is an end view of a housing showing the surface for connection with the discharge housing in accordance with the present invention.

Discharge housing 24 and/or housing 12 further define discharge ports 62 which are communicated with rotors 20, and discharge ports 62 are advantageously positioned so as to extend away from rotors 20 both radially and axially. Discharge ports 62 may be defined by discharge housing 24 alone, or may be partially defined by housing 12, specifically a portion of rotor housing section 16. FIGS. 5–7 illustrate portions of each of these members which define the desired discharge ports.

Discharge ports 62 allow for rotor tips and end clearances to be checked, through the discharge ports, after the compressor is assembled.

FIG. 7 shows an end face 64 of rotor housing section 16, including inner surfaces 66 which define at least partially cylindrical areas for housing rotors 20 as desired. A portion of discharge port 62 is shown at 68, and extends away from rotors 20 in a radial direction so as to allow radial discharge from rotors 20 as desired.

Turning to FIG. 6, another portion 70 of discharge ports 62 is illustrated, as defined on rotor side surface 52 of discharge housing 24. FIG. 6 shows the extent of rotors 20 in dashed lines so as to illustrate that portion 70 overlaps or intersects with an end surface of the area defined for rotors such that compressor medium can be discharged axially, as well as radially, from rotors 20 into discharge ports 62 as desired.

As shown, discharge port portion 70 as defined through discharge housing 24 preferably extends helically from rotor side surface 52 to discharge side surface 54 so as to accommodate the imparted swirling motion of discharged compressor medium as the medium flows to collection chamber 26 for discharge through an outlet pipe as desired. Thus, discharge housing 24 has an inlet 72 to portion 70 of discharge port 62 and an outlet 74 from portion 70 of discharge port 62 which are both illustrated in FIG. 6.

Discharge ports 62 as illustrated in FIGS. 4–7 are preferably contoured as shown so as to encourage efficient flow through same. It should of course be appreciated that these ports could be provided having a different shape, and with different contours, as desired. It is particularly advantageous, however, that discharge ports 62 intersect the substantially cylindrically-shaped housings for rotors 20 both radially and axially, at the end surface of the chamber, so as to allow for both radially and axially discharge of compressor medium from rotors 20 as desired.

Referring back to FIG. 5, it may also be desirable to provide internal relief valves 76, 78 so as to allow for relief of over-pressure behind discharge housing 24. In accordance with the present invention, discharge housing 24 has a thickness defined between rotor side surface 52 and discharge side surface 54, and reduced thickness sections 80, with relief valves 76, 78 advantageously positioned at reduced thickness sections 80. This advantageously simplifies the installation and structure of relief valves. In further accordance with this aspect of the present invention, reduced thickness sections 80 are preferably provided by forming contoured walls, or depressions in discharge side surface 54 so as to define the reduced thickness sections in which valves 76, 78 are mounted. The contoured walls advantageously serve to reduce disruption of flow in collection chamber 26, which is defined in part by discharge side surface 54, while nevertheless allowing for installation of relief valves 76, 78 at positions of reduced thickness as desired.

Collection chamber 26 is illustrated in FIG. 1 and is any suitable end-cap structure suitable for securing to discharge housing 24. Collection chamber 26 and the end wall of discharge housing 24 define a collection zone for compressed medium, and collection chamber 26 is preferably provided having an outlet 82 for discharge of compressed medium from compressor 10.

It should readily be appreciated that the foregoing disclosure provides a housing for a compressor which is a substantial improvement over existing compressor housings and which allows for efficient cooling of the motor and flow of compressor medium while also allowing simplified access to rotors disposed in the housing for routine maintenance and the like.

The compressor housing finds particular use in connection with screw compressors for the HVRAC industry, and is particularly useful for this motor-rotor configuration. The housing is equally useful in connection with other helical type compressors, for example compressors with different working fluids such as helium, air, ammonia and the like, and this housing finds equal application in compressors which have different configurations of driven rotors, as well.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A housing for a screw compressor, comprising:

a single-piece casting defining a motor housing section and a rotor housing section and having an inlet for compressor medium, an outlet end and a bridge member disposed between said motor housing section and said rotor housing section and defining an inlet side bearing housing;

a discharge housing mounted to said outlet end and defining a discharge outlet and a discharge side bearing housing; and at least one rotor disposed in said rotor housing section and rotatably mounted between said inlet side bearing housing and said discharge side bearing housing, wherein said rotor comprises a sun rotor and at least two planet rotors, and wherein said inlet side bearing housing and said discharge side bearing housing define bearings for said sun rotor and said at least two planet rotors, and wherein at least one of said rotor housing section and said discharge housing define at least one discharge port for discharging medium from said sun rotor, said discharge port extending away from said sun rotor both radially and axially.

2. The housing of claim 1, wherein said inlet is positioned between and communicated with said motor housing section and said rotor housing section, whereby compressor medium flow into said inlet cools said motor housing section.

3. The housing of claim 1, further comprising a collection chamber communicated with said at least one discharge port and having an outlet whereby medium from said at least one discharge port is conveyed to said outlet.

4. The housing of claim 1, wherein said rotor housing section and said discharge housing define in combination an at least partially cylindrical surface within which said rotor is positioned and a discharge end surface, and wherein said discharge port intersects both said at least partially cylindrical surface and said end surface whereby discharged medium is discharged from said rotor to said discharge port both radially and axially.

5. The housing of claim 1, wherein said casting has an inner surface and said bridge member extends inwardly from said casting to define said inlet side bearing housing with at least two flow channels defined between said bridge member and said inner surface whereby said rotor is fed with said compressor medium through said at least two flow channels.

6. The housing of claim 5, wherein said bridge member defines bearings for said at least one rotor, said bearings comprising a substantially continuous circular surface.

7. The housing of claim 1, further comprising a motor disposed in said motor housing section and operatively associated with said rotor through said bridge member.

8. The housing of claim 7, wherein said motor has an axial length, and wherein said motor housing section extends at least as far as said axial length of said motor.

9. The housing of claim 1, wherein said discharge housing has a rotor side surface and a discharge side surface, and a thickness defined between said rotor side surface and said discharge side surface and further comprising at least one reduced thickness section in said discharge housing and at least one relief valve positioned through said discharge housing at said reduced thickness section.

10. The housing of claim 9, wherein said reduced thickness section is defined by a contoured wall set into said discharge housing from said discharge side surface.

* * * * *